US006962023B2

(12) United States Patent
Daniels et al.

(10) Patent No.: US 6,962,023 B2
(45) **Date of Patent: *Nov. 8, 2005**

(54) POWER DRIVE MECHANISM FOR A MOTOR VEHICLE LIFTGATE HAVING A DISENGAGEABLE GEAR TRAIN

(75) Inventors: Andrew R. Daniels, Newmarket (CA); Peter Lance Oxley, Mount Albert (CA); Andre Olivier, Raleigh, NC (US); Victor Gusev, Toronto (CA); Thomas P. Frommer, Mount Albert (CA); Wieslaw Nowicki, Mississauga (CA); Grzegorz Baniak, Etobicoke (CA); Robert B. Mooney, Farmington Hills, MI (US); Frederick C. Butler, Davisburg, MI (US)

(73) Assignees: DaimlerChrysler Corporation, Auburn Hills, MI (US); Atoma International Corp., Newmarket (CA)

( * ) Notice: Subject to any disclaimer, the term of this patent is extended or adjusted under 35 U.S.C. 154(b) by 0 days.

This patent is subject to a terminal disclaimer.

(21) Appl. No.: 10/806,550

(22) Filed: Mar. 23, 2004

(65) Prior Publication Data

US 2004/0177559 A1 Sep. 16, 2004

Related U.S. Application Data

(63) Continuation of application No. 09/959,222, filed as application No. PCT/CA00/00546 on Feb. 5, 2002.

(60) Provisional application No. 60/132,701, filed on May 5, 1999.

(51) Int. Cl.[7] ..... E05F 15/12

(52) U.S. Cl. ..... 49/342; 49/341; 49/340; 49/139

(58) Field of Search ..... 49/334, 339, 340, 49/341, 342, 139, 140; 296/146.4, 146.8, 296/56; 74/89.18, 405, 406; 192/20

(56) References Cited

U.S. PATENT DOCUMENTS

| | | | |
|---|---|---|---|
| 951,037 | A | 3/1910 | Winton |
| 1,341,775 | A | 6/1920 | Bowers |
| 1,770,641 | A | 7/1930 | Brennan |

(Continued)

FOREIGN PATENT DOCUMENTS

| | | |
|---|---|---|
| EP | 0 169 245 | 1/1985 |

(Continued)

OTHER PUBLICATIONS

PCT International Search Report (Continued)

*Primary Examiner*—Gregory J. Strimbu
(74) *Attorney, Agent, or Firm*—Ralph E. Smith

(57) ABSTRACT

A power drive mechanism (10) for a motor vehicle liftgate includes a linking arm (18) pivotally connected with the liftgate, a crank arm (12) drivable for pivotal movement and connected with the linking arm (18), and a gear train (20) operatively engaging the crank arm (12). A drive motor (34) is operatively connected with the crank arm (12) through the gear train (20) to provide power assisted opening and closing of the liftgate. The gear train (20) is disengagable from the drive motor (34) to permit manual opening and closing of the liftgate without backdriving the drive motor (34). An actuator (74) is operatively connected with the gear train (20) to move the gear train into and out of engagement with the drive motor. A holding linkage (60, 62) is operatively associated with the gear train (20) to maintain the gear train (20) in engagement during power assisted opening and closing of the liftgate.

13 Claims, 7 Drawing Sheets

U.S. PATENT DOCUMENTS

| | | | | | |
|---|---|---|---|---|---|
| 2,175,086 | A | | 10/1939 | Mitchell | |
| 2,514,272 | A | | 7/1950 | Winkelman | |
| 2,813,434 | A | | 11/1957 | Stuebs | |
| 2,833,536 | A | | 5/1958 | Joachim et al. | |
| 3,601,234 | A | * | 8/1971 | Ingraham | 477/15 |
| 4,106,353 | A | | 8/1978 | Kondo | |
| 4,495,827 | A | | 1/1985 | Parizet | |
| 4,621,535 | A | * | 11/1986 | Bronson et al. | 74/405 |
| 4,842,349 | A | * | 6/1989 | Stenemann | 312/116 |
| 4,843,903 | A | | 7/1989 | Tanaka et al. | |
| 4,854,635 | A | | 8/1989 | Durm et al. | |
| 4,960,006 | A | | 10/1990 | Moore | |
| 4,981,349 | A | | 1/1991 | Tamiya et al. | |
| 5,109,968 | A | | 5/1992 | Pollitt et al. | |
| 5,209,057 | A | | 5/1993 | Remlaoui | |
| 5,448,856 | A | | 9/1995 | Moore et al. | |
| 5,497,844 | A | | 3/1996 | Fritzinger | |
| 5,794,381 | A | | 8/1998 | Rizkovsky | |
| 6,055,776 | A | * | 5/2000 | Dettling et al. | 49/341 |
| 6,070,482 | A | | 6/2000 | Kugio et al. | |
| 6,092,336 | A | | 7/2000 | Wright et al. | |
| 6,092,337 | A | | 7/2000 | Johnson et al. | |
| 6,142,551 | A | | 11/2000 | Ciavaglia et al. | |
| 6,270,147 | B1 | | 8/2001 | Butler et al. | |
| 6,575,864 | B1 | * | 6/2003 | Dean | 475/5 |

FOREIGN PATENT DOCUMENTS

| | | |
|---|---|---|
| EP | 0 333 901 | 9/1989 |
| EP | 0 367 134 | 10/1989 |
| EP | 0 545 197 A1 | 11/1992 |
| EP | 0 837 211 | 4/1998 |

OTHER PUBLICATIONS

Japan Publication No. 04081338, Publication Date Mar. 16, 1992.

Japan Publication No. 04166440, Publication Date Jun. 12, 1992.

Japan Publication No. 09309382, Publication Date Dec. 2, 1997.

Japan Publication No. 61057444, Publication Date Mar. 24, 1986.

* cited by examiner

POWER DRIVE MECHANISM FOR A MOTOR VEHICLE LIFTGATE HAVING A DISENGAGEABLE GEAR TRAIN

This application is a continuation of U.S. patent application Ser. No. 09/959,222, filed Feb. 5, 2002, which is a 371 of PCT/CA00/00546, filed May 5, 2000, which claims benefit of U.S. Provisional Patent Application Ser. No. 60/132,701, filed May 5, 1999.

FIELD OF THE INVENTION

The invention relates to power drive mechanisms for power operation of a vehicle liftgate.

BACKGROUND OF THE INVENTION

Minivans and recreational vehicles frequently have rear liftgates that are pivotally mounted to the vehicle frame at the rear of the vehicle. The liftgate is pivotally mounted to the frame by top hinges to allow the liftgate to move between open and closed positions.

Manually operated liftgates and power operated liftgates are well known. Power operated liftgates can be opened and closed manually if a vehicle user so desires. Power operated liftgates are typically driven in opening and closing directions by an electrical motor that is operatively engagable with the liftgate through a series of gears. At least one gear is movably mounted for movement between engaging and disengaging positions so that the motor is operatively connected to the liftgate when the gears are engaged so the liftgate can be moved in opening and closing directions by the motor and is disconnected from the liftgate when the gears are disengaged so the liftgate can be opened and closed manually without backdriving the motor. Examples of typical systems include U.S. Pat. Nos. 5,448,856 and 5,563,483.

The movable gear may have a tendency to move out of engagement when the motor is either opening or closing the liftgate, depending on the particular geometry. This is undesirable because movement of the movable gear can result in gear slippage and/or in excessive gear noise.

SUMMARY OF THE INVENTION

The disadvantages of the prior art may be overcome by providing a power drive mechanism in which a gear train can be releasably locked or held in driving engagement during power assisted liftgate opening and closing and can be released from driving engagement thereafter to give the vehicle user the option of manually opening or closing the liftgate without backdriving the drive motor.

According to one aspect of the invention, there is provided a power drive mechanism for a driving a liftgate for a vehicle. The vehicle has a body controller controlling the operation of the power drive mechanism. The liftgate has a power operated latch assembly capable of primary and secondary latching engagement with a striker on the vehicle to releasably latch the liftgate and capable of power operated unlatching of the latching assembly. The power drive mechanism has a mounting bracket mountable on a "D" pillar of the vehicle. A linking arm is pivotally connected with the liftgate. A crank arm is pivotally mountable on the mounting bracket and pivotally connected with the linking arm. A gear train is pivotally mounted on said mounting bracket. A drive motor is mounted to the mounting bracket. The drive motor is operatively connected with the crank arm through the gear train. The gear train is movable between an engaged position and a disengaged position. The engaged position effects a driving engagement between the drive motor and the crank arm such that energizing the drive motor drivingly rotates the crank arm to responsively effect opening and closing of the liftgate. The disengaged position disengages the drive motor from the crank arm permitting movement of the crank arm without backdriving the drive motor. An actuator is operatively connected with the gear train and is operable to effect the movement of the gear train. A holding linkage is operatively connected between the gear train and the actuator to maintain the driving engagement once the actuator moves the gear train into the engaged position. A switch is mounted on the mounting bracket and is switchable in response to movement of the crank arm, indicating open and closed conditions of the liftgate. An electronic control unit electrically communicates with the body controller, the latch assembly, the drive motor, the switch and the actuator.

DETAILED DESCRIPTION OF THE PREFERRED EMBODIMENT OF THE INVENTION

Figure 1:
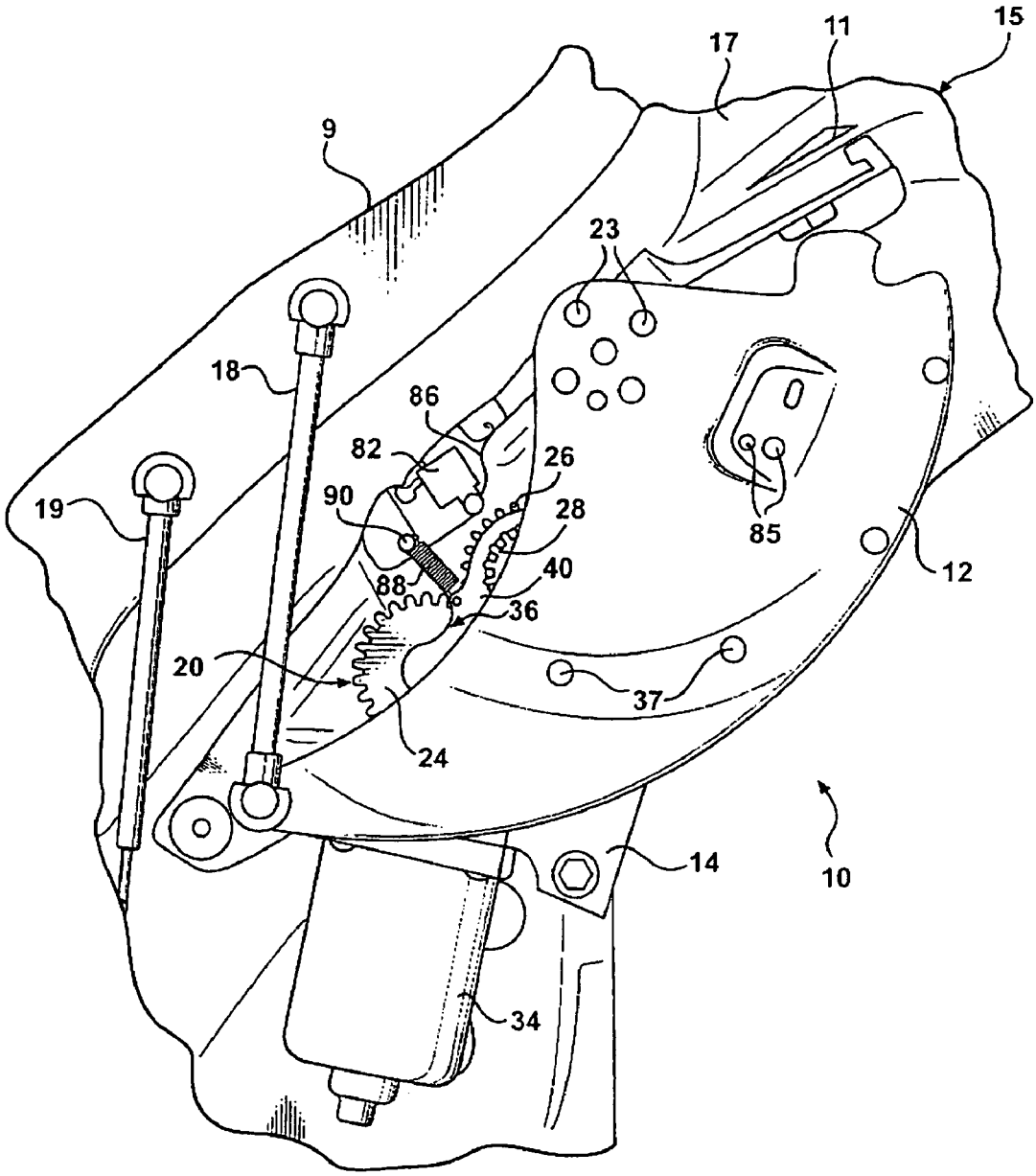
FIG. 1 is a perspective view of a power drive mechanism constructed according to the principles of the present invention mounted on a "D" pillar of a conventional motor vehicle.

A power drive mechanism, generally designated 10, for power operated opening and closing of a vehicle liftgate 9 is shown in FIG.1. The structure of the vehicle liftgate 9 is conventional and is illustrated in U.S. Pat. Nos. 5,448,856 and 5,563,483. A typical vehicle liftgate 9 is pivotally mounted at the rear of a mini van or recreational-type vehicle by hinges (not shown) mounted between the top of the vehicle liftgate 9 and a portion 11 of the frame 15 of the vehicle. The liftgate 9 has a conventional power operated latch assembly (not shown) mounted at a central portion of its lower edge that releasably latches to a striker appropriately mounted on the vehicle frame.

When the latch assembly is released from the striker, the liftgate can be pivoted about the hinges from a lowered closed position to a raised open position to allow access to the vehicle interior through the rear of the vehicle. Typically, a gas strut of conventional construction is mounted between a respective side edge of the liftgate and an adjacent, generally vertically extending pillar 17 (each of which is referred to as a "D" pillar) of the vehicle frame.

The power drive mechanism 10 of the present invention is mounted on the "D" pillar 17 of the vehicle on the left side thereof (from the point of view of a forwardly facing vehicle occupant) and is operatively engaged with the liftgate to provide power operated opening and closing of the same.

The power drive mechanism 10 includes a crank arm 12 that is that is drivable for pivotal movement. The crank arm 12 is pivotally mounted to a mounting bracket 14 for power operated pivotal movement in opening and closing directions with respect thereto. The mounting bracket 14 is rigidly secured to an upper portion of the "D" pillar as shown in FIG. 1. The mounting bracket 14 is a metal structure preferably made of diecast zinc or aluminum, although any metal of suitable strength could be used, and is secured to the "D" pillar by conventional fastener such as bolts. The crank arm 12 is preferably constructed of stamped metal, the preferred metal being steel. The crank arm 12 is pivotally mounted to the mounting bracket 14 by a support structure 21 that extends essentially in the cross vehicle direction. The crank arm 12 is secured to the support structure 21 by rivets 23.

The crank arm 12 is connected with a linking arm 18. One end of a rigid linking arm 18 is pivotally mounted to the crank arm 12 and the opposite end of the linking arm 18 is pivotally connected to the adjacent side edge of the liftgate. The pivotal connection between the linking arm 18 and the liftgate is spaced from the hinges and the axis of rotation of the liftgate. Movement of the crank arm 12 in opening and closing directions acts through the linking arm 18 to move the liftgate in its opening and closing directions.

A gear train, generally designated 20, operatively engages the crank arm 12. The preferred embodiment of the gear train 20 includes a plurality of gears, including an actuator gear 24, inner and outer drive gears 26 and 28, respectively.

A drive motor 34 is operatively connected with the crank arm 12 through the gear train 20 and is operable to automatically open and close the liftgate. A motor gear 22 is rotatably mounted on the mounting bracket 14 by a shaft 32 that is operatively connected in a conventional manner with the drive motor 34 which is preferably a reversible, high-torque electrical motor. The drive motor 34 can be electrically energized to effect bi-directional rotation of the same.

The actuator gear 24 is rotatably mounted on a bracket assembly 36. The bracket assembly 36 includes inner and outer bracket members 38 and 40, respectively, and the actuator gear 24 is mounted therebetween by a pin or rivet 42. The bracket members 38, 40 are preferably made of steel and are rigidly secured together by rivets 39.

The inner drive gear 26 and the outer drive gear 28 are ganged together and rigidly secured to a common shaft 44 that is rotatably mounted to the mounting bracket 14 to allow the gears 26, 28 to rotate with respect to the mounting bracket 14. The bracket assembly 36 is pivotally disposed on the central shaft 44 for movement thereabout between engaged and disengaged positions. The pivotal movement of the bracket assembly 36 is independent of the rotational movement of the inner and outer drive gears 26, 28.

The gears 22, 24 within the gear train 20 are disengagable to permit manual opening and closing of the liftgate without backdriving the drive motor 34. Pivotal movement of the bracket assembly 36 about the central shaft 44 with respect to the mounting bracket 14 moves the actuator gear 24 in and out of meshing, torque transmitting engagement with the motor gear 22. When the gears 22, 24 are disengaged, the pivotal movement of the crank arm 12 which occurs during liftgate opening and closing does not rotate the motor gear which protects the drive motor 34.

A sector gear 30 is rigidly attached to the crank arm 12 by conventional rivets 37. The sector gear 30 has a series of teeth on the inside or concave circumferential edge thereof. The outer drive gear 28 is in meshing, torque transmitting engagement with the sector gear 30. Rotation of the outer drive gear 28 acting through the sector gear 30 moves the crank arm 12. The outer gear 28 remains in meshing engagement with the sector gear 30 throughout the entire range of pivotal movement of the crank arm 12.

The pivotal movement of the bracket assembly 36 between engaged and disengaged positions is controlled by the movement of a U-shaped actuating link 46 that is pivotally mounted at the bight portion thereof to the mounting bracket 14 through pin 48. The actuating link 46 is a metal structure preferably made of steel and has integral upper and lower arms 50, 52 extending from a U-shaped body portion 53. The actuating link 46 is operatively connected to the bracket assembly 36 through a roller 54 rotatably mounted pin 55 on the upper arm 50. The roller 54 rollingly engages one of first and second flanges 56, 58, respectively, integrally formed on an arm of the inner bracket member 38. Pin 55 extends through slot 57 which extend parallel to and between flanges 56, 58. The roller 54 cams against a flange 56 or 58 during pivotal movement of the actuating link 46 to pivot the bracket assembly 36 with respect to the mounting bracket 14 about the central shaft 44 between engaged and disengaged positions.

The actuating link 46 is operatively associated with a holding linkage comprising a holding link 60 (partially cut away in FIG. 4) and an elongated, rigid connecting link 62. Connecting link 62 that is pivotally mounted between the lower arm 52 and an upper portion of the holding link 60 by conventional rivets 64. The holding link 60 is operatively associated with the gear train 20 to maintain the gears 22, 24 in engagement with one another during automatic operation of the liftgate. An edge portion of the holding link 60 is pivotally mounted to an edge portion of the bracket assembly 36 by a pin 65. The holding link 60 is a metal structure preferably made of steel and is provided with a slot 66 that defines a plurality of notches therein including an upper releasing notch 68 and a lower holding notch 70. A holding pin 72 is rigidly secured to the mounting bracket 14 and is received within the slot 66. The holding link 60 slidably engages the pin 72 for guiding movement of the holding link 60 with respect to the pin 72 between holding and releasing positions.

Figure 2:
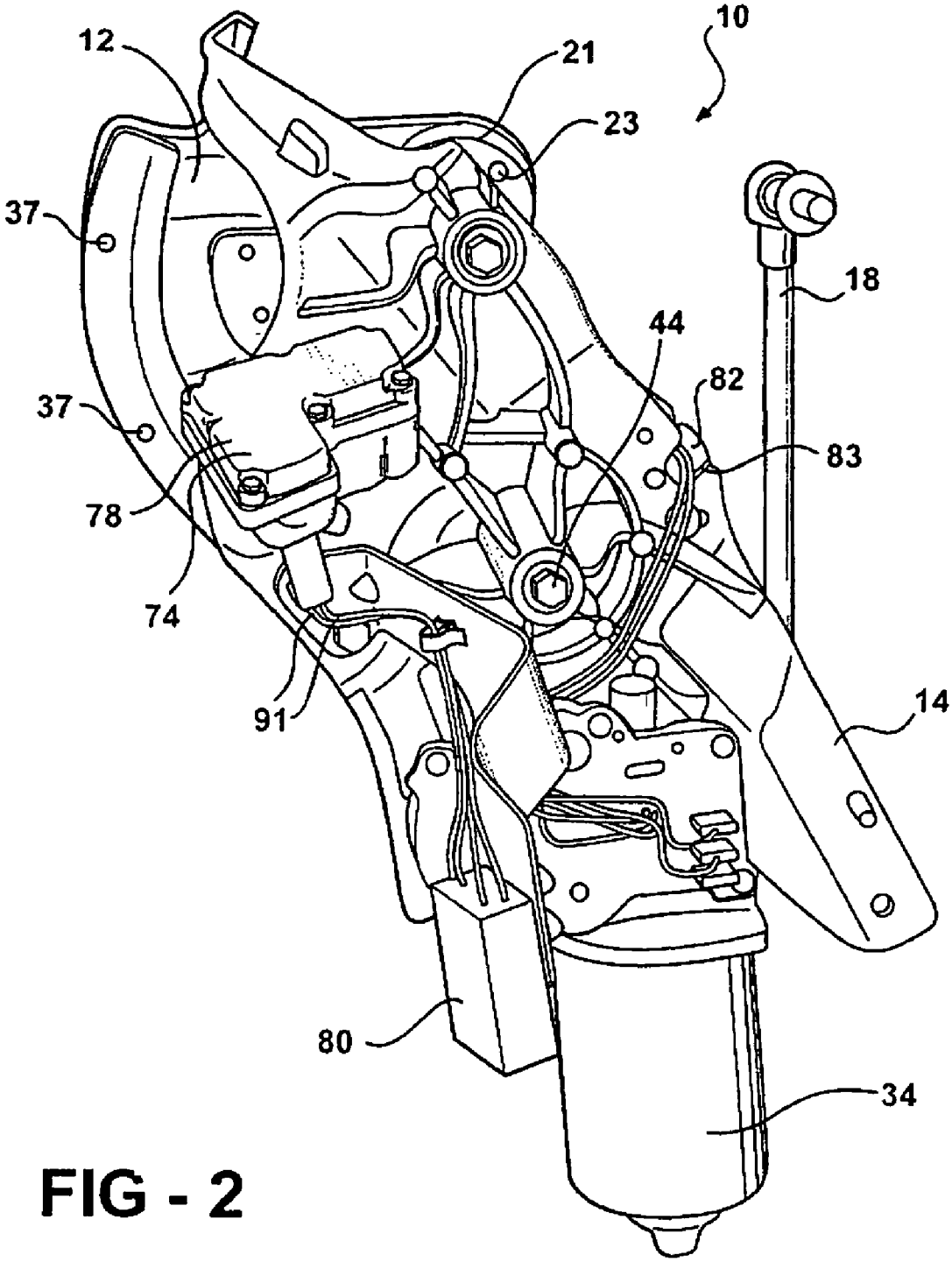
FIG. 2 is a perspective view of the power drive mechanism in isolation showing an opposite side of the mechanism from the side shown in FIG. 1.
Figure 3:
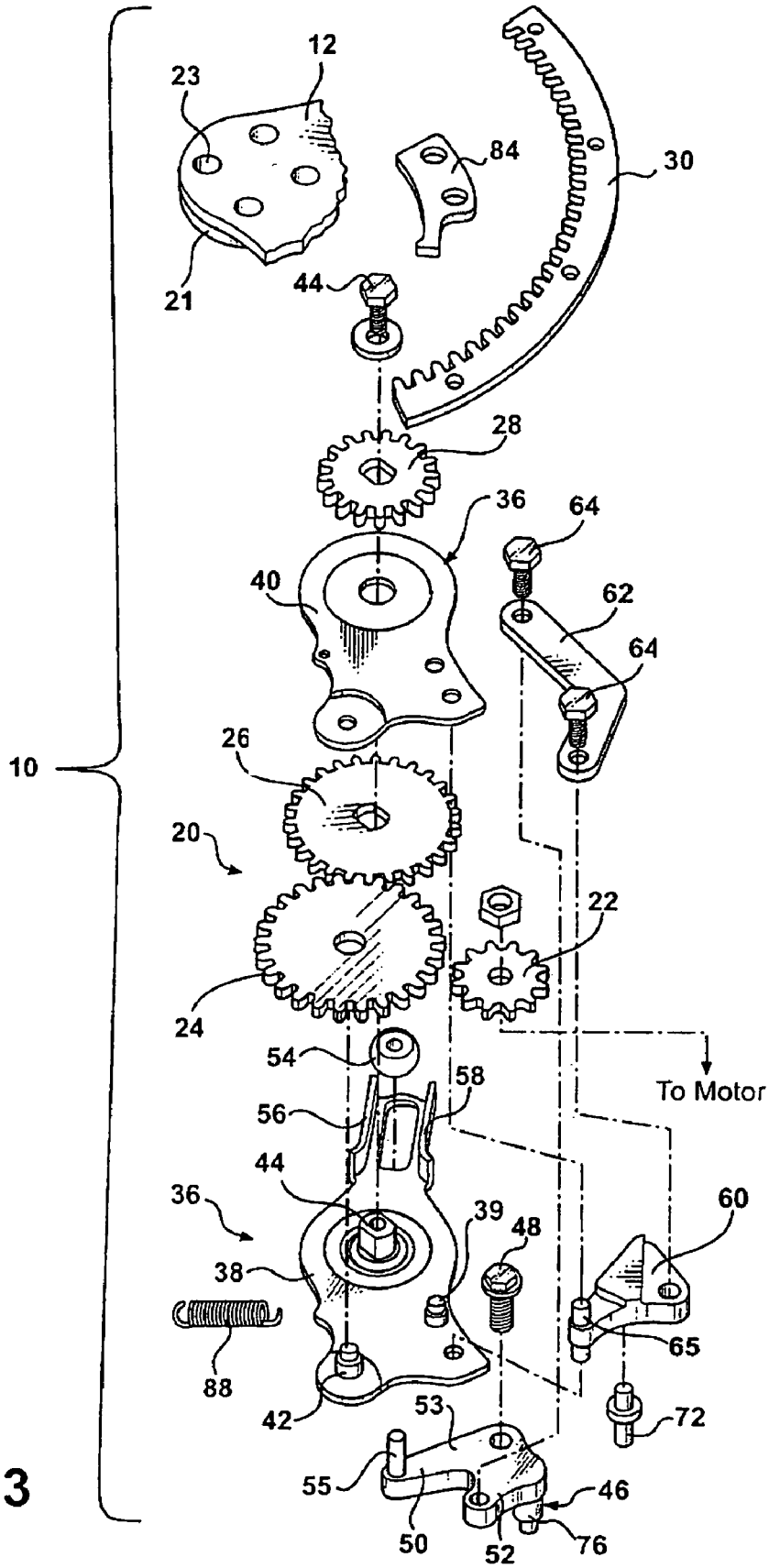
FIG. 3 is an exploded view of the power drive mechanism.

Movement of the actuating link 46 is effected by an actuator 74, best seen in FIG. 2, which shows the side of the mounting bracket 14 that is in contact with the "D" pillar when the power drive mechanism 10 is mounted in a vehicle. The actuator comprises a motor and a gear train which are conventional and are enclosed within an L-shaped protective plastic housing 78 mounted on the mounting bracket 14. The actuator 74 is operatively connected with the gear train 20 and is operable to engage and disengage the gears 22, 24 of the gear train. The actuator includes a conventional reversible electric motor and gear train (not shown) that engages a shaft 76 rigidly connected on the actuating link 46 that extends through an arcuate slot (not shown) in the mounting bracket 14. When the motor in the actuator 74 moves the shaft 76, the actuator assembly 46 pivots between its engaging and disengaging positions.

An extension spring 88 is mounted between a post 90 and the bracket assembly 36 to bias the bracket assembly to disengage from the motor gear 22 when the vehicle is moving or when the liftgate is being manually opened or closed.

Operation

Power operation of the power drive mechanism 10 can be controlled electronically using conventional electronic control circuitry which is mounted in the vehicle. The actuator gear 24 is normally not in meshing engagement with the motor gear 22. The control circuitry can be programmed such that when power operated liftgate opening is initiated, the actuator 74 and drive motor 34 are energized in sequence. The actuator 74 moves the actuator gear 24 into engagement with the motor gear 22 and moves the holding link 60 into locking relation with the holding pin 72 to releasably hold the actuator gear 24 and motor gear 22 together during power liftgate movement. The drive motor 34, acting through the gear train 20, moves the crank arm 12 in its opening direction. The circuitry then disengages the holding link 60 from the holding pin 72 and moves the actuator gear 24 and motor gear 22 out of meshing engagement when the gate is open. The powered closing operation is essentially the reverse of the opening operation. During power operated liftgate closing, the gear holding link 60 holds the actuator gear 24 and the motor gear 22 in meshing, torque transmitting engagement to prevent the gears 22, 24 from slipping relative to one another and to reduce or eliminate gear noise.

Figure 4:
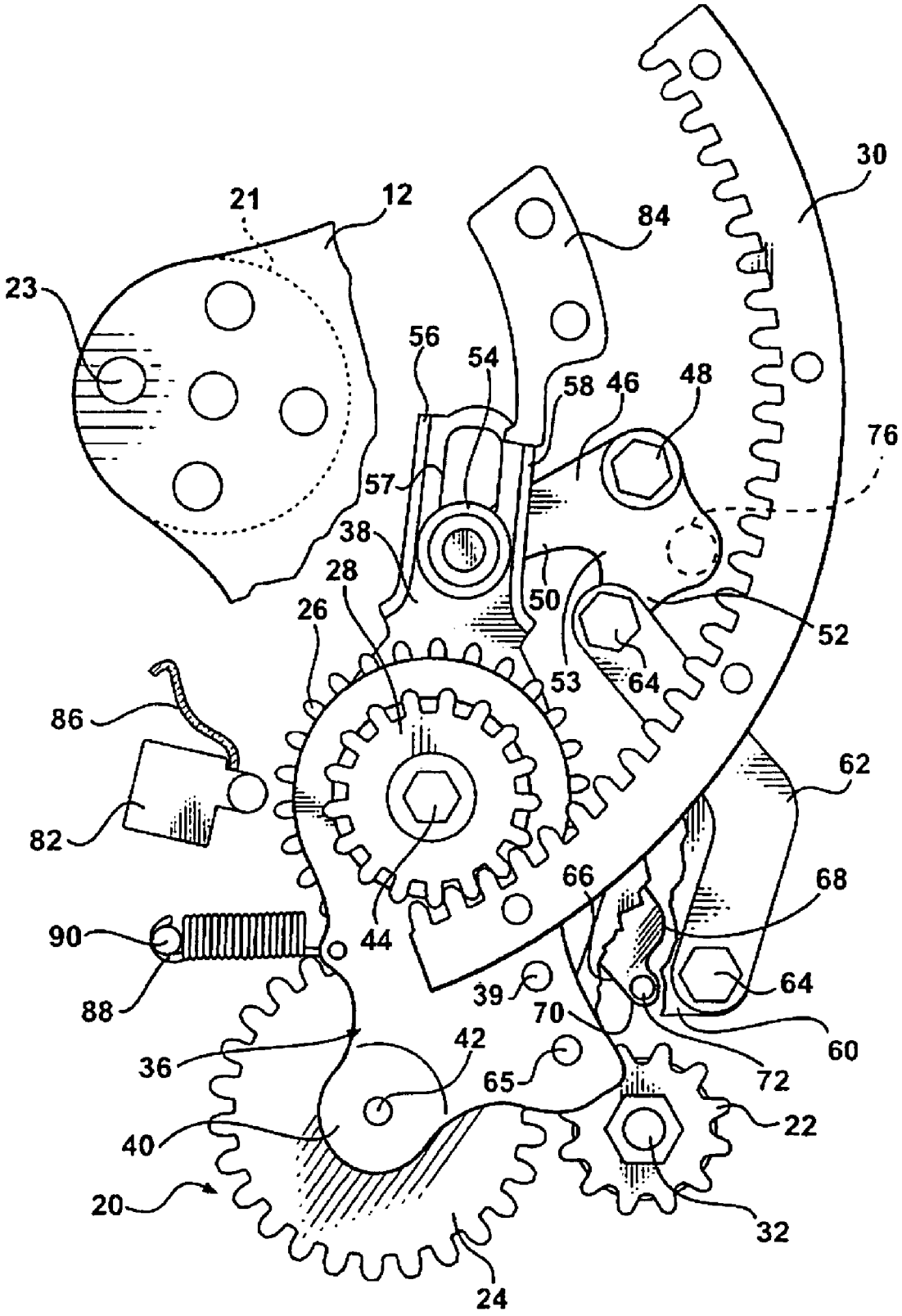
FIG. 4 is an elevational view of a gear train, a fragment of a crank arm and a switch of the power drive mechanism in isolation and showing the gear train in a disengaged condition, the crank arm in a closed position and the switch in a full open position.

The basic operation of the power drive mechanism 10 can be understood from FIGS. 4–7. FIGS. 4–7 show a plurality of structures of the power drive mechanism 10 in isolation to show the relative positions thereof prior to and during power operation. FIG. 4 shows the configuration of the power drive mechanism 10 before power operated liftgate opening is initiated by a vehicle user. The system described uses a conventional key fob remote control transmitter to initiate powered liftgate opening and closing. To initiate power liftgate opening when the liftgate is closed and latched, the vehicle user actuates the key fob remote control unit which sends a signal to a body controller located in the vehicle.

In response to the signal generated by the key fob, the body controller sends an electronic control signal to a liftgate electronic control unit 80 mounted in the rear of the vehicle near the mounting bracket 14. The electronic control unit 80 confirms that the latch assembly is latched and the liftgate is closed by detecting the position of a ratchet switch and a pawl switch in the latch assembly and of a switch 82 in the power drive mechanism 10 and then actuates a motor and clutch assembly (not shown) associated with the latch assembly on the liftgate to effect power operated unlatching of the same to release the latch assembly from the striker. The electronic control unit 80 is in electrical communication with the switch 82 through conventional wires 83. Movement of a ratchet and pawl during unlatching toggles the ratchet and pawl switches in the latch assembly during unlatching which indicates to the electronic control unit 80 that the latch assembly is unlatched.

In response to the switch signals from the latch assembly, the electronic control unit 80 energizes the drive motor 34 to cause it to rotate slowly in an opening direction at about ten percent of its duty cycle and then, a predetermined amount of time thereafter (typically about 30 milliseconds), energizes the actuator motor in the actuator 74 to cause it to rotate in a gear engaging direction. The actuator is in electrical communication with the electronic control unit 80 through conventional wires 91. The actuator 74 is energized for a predetermined period of time (typically about 350 milliseconds) which causes the actuating link 46 to pivot in a gear engaging direction (clockwise in FIGS. 4–7).

Figure 5:
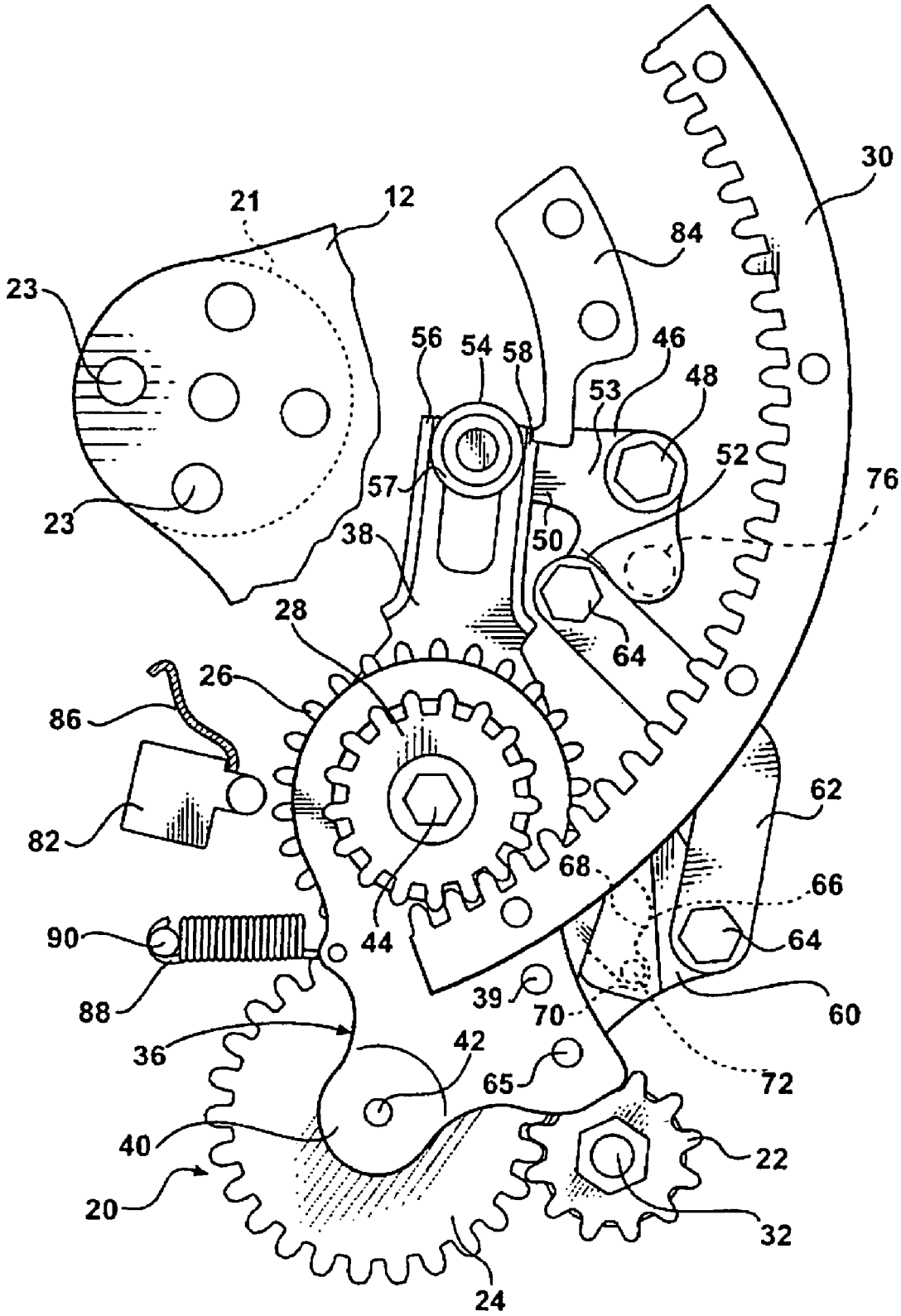
FIG. 5 is a view similar to FIG. 4 except showing the gear train in an engaged condition.

As the actuating link 46 pivots, the bracket assembly 36, holding link 60, and connecting link 62 move to mesh the actuator gear 24 into engagement with motor gear 22 and lock them in meshing engagement as shown in FIG. 5. More specifically, as the actuator assembly 46 pivots (clockwise from the point of view in FIG. 4), the roller 54 cams against the first wall portion 56 of the inner bracket member 38 to pivot the bracket assembly 36 about the central shaft 44 (counterclockwise in FIG. 4) and move the actuator gear 24 into meshing engagement with the slowly rotating motor gear 22. The pivotal movement of the actuating link 46 acting through the connecting structure 62 and the bracket assembly 36 simultaneously (i.e., simultaneous with the movement of the bracket assembly 36) causes the holding link 60 to pivot about pin 65 and thus move with respect to the holding pin 72 until the holding pin 72 is disposed generally within the holding notch 70 which locks the bracket assembly 36 in place. The actuator gear 24 is thereby locked in meshing engagement with the motor gear 22 until the actuating link 46 is pivoted in the reverse direction. This configuration of the power drive mechanism 10 is shown in FIG. 5.

When the actuation gear 24 is engaged with the motor gear 22, the drive motor 34 drives the gears 22, 24, 26, 28, 30 in an opening direction to cause the crank arm 12 to move in its opening direction. It can be appreciated that when the liftgate is moving in the opening direction, the holding link 60 is not required to maintain the actuator gear 24 and the motor gear 22 in meshing engagement. As the liftgate is opening, the crank arm 12 pivots about an axis defined by the support structure 21 in a clockwise direction (from the point of view of FIGS. 4–6). The inner and outer drive gears 26, 28 rotate in a clockwise direction and the actuator gear 24 and motor gear 22 rotate respectively in counterclockwise and clockwise directions. The forces exerted on the actuator gear 24 and motor gear 22 tend to move them together as the liftgate opens. Those skilled in the art will understand that because the motor gear 22 is rigidly mounted on a shaft 32 that extends through and is rotatably disposed within an aperture (not shown) in the mounting bracket 14 but is prevented from moving with respect to the mounting bracket 14 in a direction generally perpendicular to its axis of rotation (i.e., it is restricted to rotational movement with respect to the mounting bracket by the sides of the aperture), and because the actuator gear 24 is rotatably mounted on rivet 42 which is free to move with respect to the mounting bracket 14 (because the bracket assembly 36 on which the rivet 42 is mounted is pivotally mounted about the central shaft 44), the rotational movement of the motor gear 22 in the clockwise direction tends to pivot the bracket assembly 36 in a counterclockwise direction with respect to the mounting bracket 14, thereby tending to move the actuator gear 24 into engagement with the motor gear 22.

As the crank arm 12 moves in the opening direction, the linking arm 18 pivotally mounted between the crank arm 12 and the left edge of the liftgate, moves the liftgate upwardly toward its open position as the gas struts 19 elongate. The structure and operation of the gas struts is conventional and well known. Each gas strut includes an elongated structure that is spring biased to move telescopically out of a second elongated structure to provide a spring biased pushing force as the first elongated structure moves outwardly. The speed of the outward movement is limited in a well known manner, typically by a restricted flow of a gas within the strut. It is well known that before the spring biased movement of the gas strut begins; however, the first structure must be moved out of the second member a predetermined distance. The linking arm 18 and crank arm 12 push the liftgate upwardly during a power gate opening operation almost the entire upward range of movement of the liftgate. Because there is only one power drive mechanism 10 associated with the liftgate, a large torsional force is applied to the mounting bracket 14 during the liftgate opening and closing.

As the crank arm 12 moves in the opening direction, the electronic control unit 80 increases the drive motor 34 power after a predetermined number of revolutions of the motor shaft of the drive motor 34 to full duty cycle power and the linking arm 18 moves the liftgate toward its open position. As the liftgate is opening, the electronic control unit 80 monitors the Hall effect counts (in a conventional manner) generated by movement of the liftgate (or, alternatively, the electronic control unit 80 could be configured to monitor the drive motor 34 current) to detect obstructions in the path of the liftgate. It will be assumed that no obstructions are encounter as the liftgate opens (or closes). As the drive motor 34 rotates in the opening direction, the electronic control unit 80 counts the revolutions of the drive motor 34 shaft and when a predetermined count is reached, the electronic control unit 80 de-energizes the drive motor 34 and the gas struts (which are almost filly extended when the drive motor 34 is de-energized) are allowed to move the liftgate to its fully open position.

Figure 6:
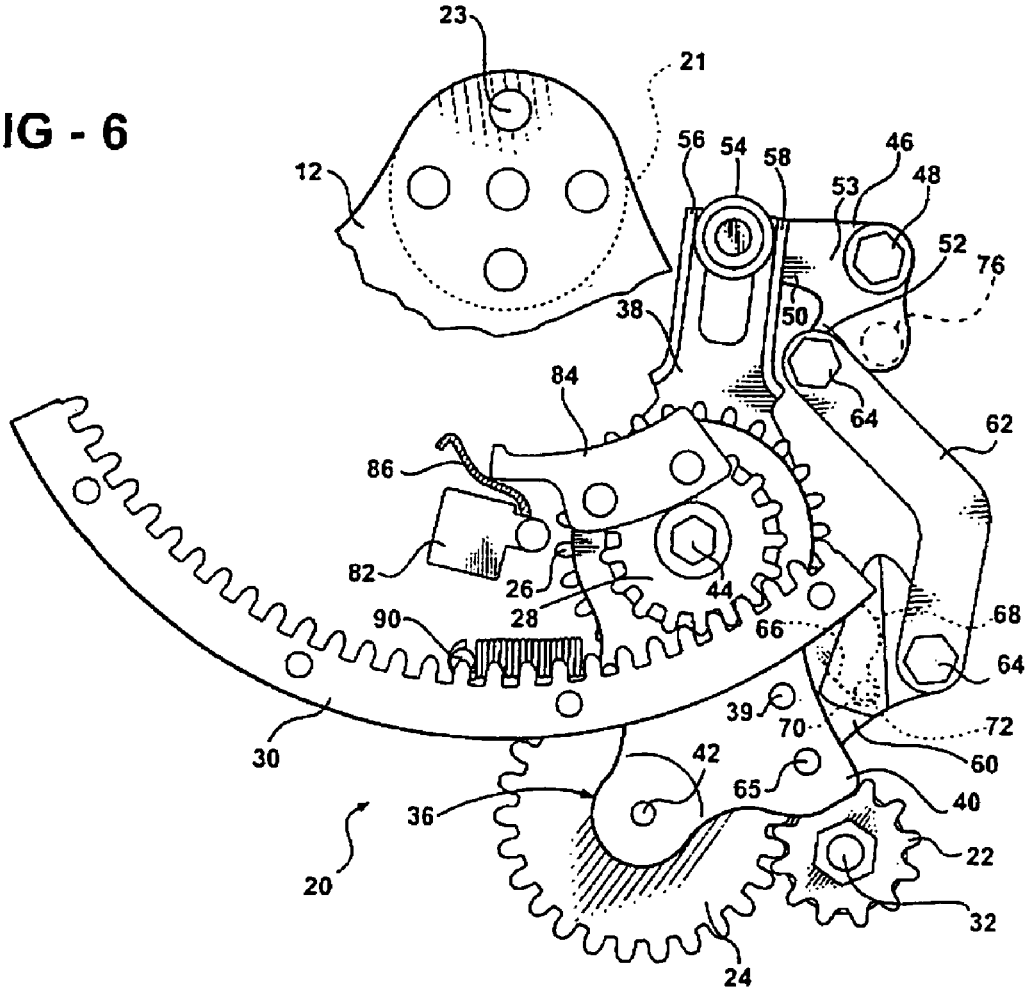
FIG. 6 is a view similar to FIG. 5 except showing the crank arm in an open position and the switch in a closed position.
Figure 7:
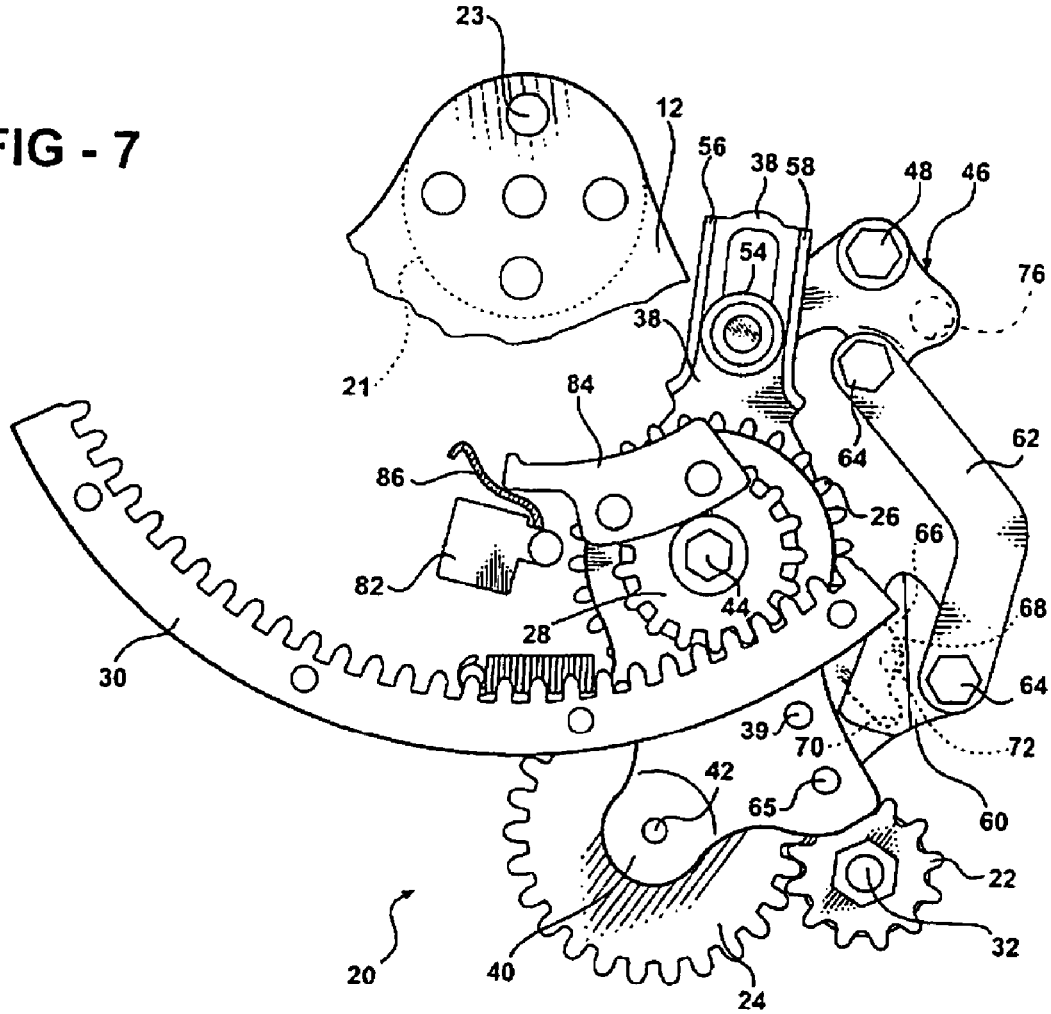
FIG. 7 is a view similar to FIG. 6 except showing the gear train in a disengaged condition.

A comparison of FIGS. 5 and 6 shows that as the crank arm 12 moves in a clockwise direction (from the point of view of FIGS. 4–7) from its fully closed position (shown in FIG. 5) to its fully opened position (FIG. 6), the switch 82 is toggled. More specifically, as the crank arm 12 is moved to its fully opened position by the gas struts, a switch arm 84 rigidly mounted on the crank arm 12 by rivets 85 moves into contact with the switch structure 86 of the switch 82 mounted in fixed relation to the mounting bracket 14 and further movement of the switch arm 84 (and crank arm 12) thereafter depresses the switch structure 86 to toggle the switch 82 to indicate to the electronic control unit 80 that the liftgate is in the full open position. The electronic control unit 80 in response energizes the actuator motor to drive the same in a disengaging direction for a predetermined period of time to disengage the actuator gear 24 from the motor gear 22 and to move the holding link 60 with respect to the holding pin 72 that the holding pin 72 is disposed in the upper releasing position to allow the actuator gear 24 to move pivotally away from the motor gear 22 to the position shown in FIG. 7. The actuator gear 24 is disengaged from the motor gear 22 when the liftgate is open, thereby allowing the vehicle user to close the vehicle liftgate manually without backdriving the motor. The liftgate is held in its fully open position by the gas struts.

The operation of the system to close the liftgate is essentially the reverse of the opening operation. When power closing is initiated with the key fob, the electronic control unit 80 first energizes the drive motor 34 to rotate in a closing direction and then energizes the actuator motor in the actuating link 46 to rotate in the engaging direction in a manner similar to that described above. The actuator motor is energized for a predetermined period of time to engage the actuator gear 24 and motor gear 22 and to move the holding link 60 simultaneously to its holding position in which the holding pin 72 is disposed in the holding notch 70. As the liftgate moves in its closing direction, the actuator gear 24 and motor gear 22 move in the clockwise and counterclockwise directions, respectively, and this tends to move them away from each other.

The drive motor 34 moves the vehicle liftgate in the closing direction until the latch assembly on the vehicle liftgate impacts the vehicle striker which moves the ratchet from an open position to a secondary latched position. Movement of the ratchet into the secondary latched position toggles the switch 82 inside the latch assembly which causes an electrical signal to be sent to the electronic control unit 80. In response to this switching signal, the electronic control unit 80 de-energizes the drive motor 34 and energizes the actuator motor for rotational movement in its disengaging direction for a predetermined period of time to move the actuator gear 24 out of engagement with the motor gear 22.

Also in response to the toggling of the switch 82, the electronic control unit 80 energizes the conventional latching motor and the clutch assembly operatively associated with the latch assembly to rotate the ratchet to its primary latched position, thereby moving the vehicle liftgate into its fully closed and latched position.

It can be appreciated that the actuator gear 24 is normally out of engagement with the motor gear 22 so that the vehicle liftgate can be opened and closed manually without backdriving the drive motor 34. This reduces wear on the drive motor 34, thereby increasing its service life and decreases the amount of manual force the user has to apply to the liftgate to open and close the same.

It is to be understood that the foregoing specific embodiment has been provided to illustrate the structural and functional principles of the present invention and is not intended to be limiting. To the contrary, the present invention is intended to encompass all modifications, substitutions and alterations within the scope of the appended claims.

What is claimed is:

1. A power drive mechanism for power assisted opening and closing of a liftgate pivotally mounted to a motor vehicle, said power drive mechanism comprising:

a linking arm pivotally connectable with the liftgate;

a crank arm pivotally mountable on the vehicle and pivotally connected with the linking arm;

a pivotally mounted gear train;

a drive motor operatively connected with said crank arm through said gear train, said gear train being movable between an engaged position and a disengaged position, said engaged position effecting a driving engagement between the drive motor and the crank arm such that energizing said drive motor drivingly rotates said crank arm to responsively effect said opening and closing of the liftgate and said disengaged position disengages said drive motor from said crank arm permitting movement of said crank arm without backdriving said drive motor;

an actuator operatively connected with said gear train and being operable upon electrical energization to effect said movement of said gear train between said engaged position and said disengaged position; and a holding linkage operatively connected to said gear train and said actuator and holds said gear train in said engaged position once said actuator moves said gear train into the engaged position including after the actuator is deenergized.

2. A power drive mechanism as defined in claim 1 wherein said gear train comprises a plurality of gears rotatably mounted to a bracket assembly in driving engagement with at least each other, said holding linkage comprises a holding link and a connecting link, said holding link pivotally connected with said bracket assembly and said connecting link, said actuator includes a pivotally mounted actuating link pivotally connected to said bracket assembly and said holding link.

3. A power drive mechanism as defined in claim 1 wherein said power drive mechanism further includes a switch electrically communicating with said actuator and operatively associated with said crank arm such that movement of said crank arm into an open position causes said crank arm to engage said switch to responsively cause said actuator to move said gear train to said disengaged position.

4. A power drive mechanism as defined in claim 3 wherein said gear train comprises a plurality of gears rotatably mounted to a bracket assembly in driving engagement with at least each other, and a spring biasing said gear train to said disengaged position.

5. A power drive mechanism as defined in claim 4, wherein said crank arm has a sector gear having a series of teeth on an inside circumferential surface thereof, said series of teeth in meshing engagement with at least one of said plurality of gears.

6. A power drive mechanism as defined in claim 5 wherein said power drive mechanism further comprises a fixedly mounted pin and said holding linkage includes a slot having a holding notch, said holding linkage slidably receiving said pin in said slot for guiding movement of said holding linkage, such that said pin is in said holding notch when said gear train is in said engaged position, said holding linkage biased to maintain said engaged position of said gear train, and a mounting bracket on which said crank arm, drive motor, pin and actuator are mounted, said mounting bracket being configured to attach to the vehicle.

7. A power drive mechanism as defined in claim 6 wherein said mounting bracket is diecast utilizing a metal selected from the group consisting of aluminum and zinc.

8. In a motor vehicle having a power drive mechanism for providing power assisted opening and closing of a liftgate pivotally mounted on the motor vehicle, said motor vehicle including a body controller to control operation of said power drive mechanism, said liftgate including a power operated latch assembly capable of latching engagement with a striker on the motor vehicle to releasably latch said liftgate and of power operated unlatching movement, said power drive mechanism comprising:

a mounting bracket mountable on a "D" pillar of said vehicle; a linking arm pivotally connected with the liftgate;

a crank arm pivotally mountable on the mounting bracket and pivotally connected with the linking arm;

a gear train pivotally mounted on said mounting bracket;

a drive motor mounted to said mounting bracket, said drive motor operatively connected with said crank arm through said gear train, said gear train being movable between an engaged position and a disengaged position, said engaged position effecting a driving engagement between the drive motor and the crank arm such that energizing said drive motor drivingly rotates said crank arm to responsively effect said opening and closing of said litigate and said disengaged position disengages said drive motor from said crank arm permitting movement of said crank arm without backdriving said drive motor;

an actuator operatively connected with said gear train and being operable upon energization to effect said movement of said gear train between said engaged position and said disengaged position;

a holding linkage operatively connected to said gear train and said actuator and holds said gear train in said engaged position once said actuator moves said gear train into the engaged position including after said actuator is deenergized;

a switch mourned on said mounting bracket and switchable in response to movement of the crank arm to sense open conditions of the litigate; and an electronic control unit electrically communicating with said body controller, said latch assembly, said drive motor, said switch and said actuator.

9. The motor vehicle of claim 8 wherein said holding linkage comprises a holding link and a connecting link, said holding link pivotally connected with a bracket assembly and said connecting link, said actuator includes a pivotally mounted actuating link pivotally connected to said bracket assembly and said holding link.

10. The motor vehicle of claim 8 wherein said motor vehicle further includes a gas strut assembly linking said liftgate to the vehicle and said electronic control unit deenergizes said drive motor after said liftgate has opened sufficiently to allow said gas strut assembly to continue opening said liftgate.

11. The motor vehicle of claim 8 wherein said gear train comprises a plurality of gears mounted on a bracket assembly in driving engagement with at least each other, and a spring biasing said gear train to said disengaged position.

12. The motor vehicle of claim 8, wherein said crank arm has a sector gear having a series of teeth on an inside circumferential surface thereof, said series of teeth in meshing engagement with said gear train.

13. The motor vehicle of claim 8 wherein said mounting bracket is diecast from a metal selected from the group consisting of aluminum and zinc.

* * * * *